US011633963B2

(12) United States Patent
Kersten et al.

(10) Patent No.: US 11,633,963 B2
(45) Date of Patent: Apr. 25, 2023

(54) FIXATION UNIT FOR USE IN A PRINTING SYSTEM

(71) Applicant: Canon Production Printing Holding B.V., Venlo (NL)

(72) Inventors: Stan H. P Kersten, Venlo (NL); Hassan Nnafie, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 0 days.

(21) Appl. No.: 17/465,158

(22) Filed: Sep. 2, 2021

(65) Prior Publication Data

US 2022/0080746 A1 Mar. 17, 2022

(30) Foreign Application Priority Data

Sep. 11, 2020 (EP) ..... 20195828

(51) Int. Cl.
*B41J 11/00* (2006.01)

(52) U.S. Cl.
CPC ..... *B41J 11/002* (2013.01)

(58) Field of Classification Search
CPC ..... B41J 11/002
See application file for complete search history.

(56) References Cited

U.S. PATENT DOCUMENTS 5,927,189 A * 7/1999 Jones ..... B41J 11/0024 399/329
2004/0017454 A1 1/2004 Yoshizawa et al.
2015/0105504 A1 4/2015 Verheggen et al.

FOREIGN PATENT DOCUMENTS

WO WO 2017/178600 A1 10/2017

OTHER PUBLICATIONS

Search Report issued in European priority application 20195828 dated Feb. 4, 2021.

* cited by examiner

*Primary Examiner* — Bradley W Thies
(74) *Attorney, Agent, or Firm* — Birch, Stewart, Kolasch & Birch, LLP

(57) ABSTRACT

A fixation unit for use in a printing apparatus includes a substantially closed box for enclosing a heated space, the substantially closed box including an entry opening and an exit opening for enabling transport of a print substrate through the substantially closed box, a heating element arranged for heating the heated space enclosed by the substantially closed box, and a transport mechanism for engaging a sheet of the print substrate from the entry opening to the exit opening of the substantially closed box. The transport mechanism includes a nip of two belts that are pressed together and run concurrently and in the same direction, the belts being impermeable to any ink component. A printer includes such a fixation unit and a printing method uses such a fixation unit.

11 Claims, 2 Drawing Sheets

FIXATION UNIT FOR USE IN A PRINTING SYSTEM

FIELD OF THE INVENTION

The present invention relates to a heater suitable for performing a post-fusing process in a printing apparatus

BACKGROUND ART

It is known in the art that the use of non-evaporating co-solvents in aqueous (latex based) ink compositions for preventing drying of the ink in the nozzles which may cause nozzle clogging may impart the final robustness (resistance towards mechanical damaging) of the printed matter.

The co-solvents need to be absorbed by the print substrate. In particular for low porosity print substrates, such as off-set coated paper, the absorption is a slow process that can be speeded up by lowering the viscosity of the ink composition, for example by drying/fixating at a high(er) temperature.

A downside of using a higher temperature in the drying stage of the printing process is that at such temperatures the evaporation rate of water increases, potentially leading to over-drying of unprinted parts of the print substrates, hence leading to deformation of the printed matter.

It is therefore an object of the present invention to find a solution to the above described dilemma: creating high quality prints with ink jet, the prints showing both a high robustness and a low print substrate deformation.

SUMMARY OF THE INVENTION

This object can be, at least partly, achieved by treating the printed matter in a fixation unit as claimed in claim 1. Such a heater comprises a nip belt transport mechanism that enables full and airtight enclosure of the printed substrate, at least those parts of the substrate that are heated (e.g. long substrates or continuous substrates (webs) are only in an airtight enclosure for the part that is in the heating zone of the fixation unit). The used transport belts forming the airtight nip are impermeable to ink components and hence are capable of keeping all liquids that might evaporate during heating in the enclosed (part of) the substrate. In this way, absorption of co-solvents into the print substrate is promoted while evaporation of water is prevented. Due to high temperature heating that can be used, the ink may further contain high MFFT (film formation at higher temperatures) latex compositions. In this way, film formation during printing and during other process steps performed at lower temperatures, e.g. (first) drying step, may be prevented which is an enhancement for color efficiency (i.e. pigment efficiency is relative amount of pigment with respect to total ink composition for obtaining a predefined desired color strength) of ink compositions Further, the end robustness of the printed matter may be enhanced after being treated in a fixation unit according to the present invention. In general, (speed of) film formation will also benefit from high temperature treatment of the printed matter.

A (heated part of the) printed substrate can be completely enclosed in the transport mechanism of the claimed heater. Hence further evaporation of water present in the print substrate and/or the ink layer printed thereon is prevented by a full and air tight enclosure of the printed substrate in the belt nip comprised in the fixation unit. This enables fixation at higher temperatures, without increasing the risk of over-drying the printed substrate and hence without increasing the risk of print substrate deformation as a consequence thereof.

In an embodiment, at least a surface of the belts that in operation comes in direct contact with printed matter comprises a material having a low surface energy for good release properties of the printed matter from the surfaces of the belts Pollution of the belts with ink residues is then prevented or at least mitigated The belt system can be folded into a compact module hence compact fixation module is enabled (small footprint).

Fast heating by conductive contact between belts and printed substrate is enabled. High MFFT latex resins being implemented in ink compositions is hence enabled In another aspect the present invention relates to a printing system comprising a printing module (comprising an image forming unit e.g. comprising ink-jet print heads), a substrate transport device arranged for transporting the substrate through the printing system; and a fixation module, comprising a fixation unit according to the present invention, the fixation module is arranged downstream of the printing module.

In an embodiment, the printing system comprises a drying module, arranged downstream of the printing module and upstream of the fixation module. The drying module comprises a drying device, e.g. (hot) air impingement device and uses mild heating conditions for drying printed substrates until the printed matter is robust enough to be handled further in the printing system.

In another aspect the present invention relates to a printing method, wherein the method comprises the steps of:

- providing a print substrate and an ink set, the ink set comprises at least one ink comprising a dispersion of polymer particles having a minimum film formation temperature (MFFT);
- printing an image with the ink set onto the print substrate;
- drying the printed substrate by exposing the print to mild heating conditions until the printed matter is robust enough to be handled in the further printing steps;
- fixating the printed substrate by transporting it through the fixation unit according any of the claims 1-2 and expose the printed matter to high heat.

In the context of the present invention, the term 'robust enough' in the drying step is to be interpreted as being able to touch the print without damaging it, which is dependent on print substrate-ink combination.

In an embodiment, the drying step is performed at a drying temperature of between 40° C. and 70° C., preferably between 45° C. and 60° C., more preferably between 50° C. and 55° C., for 0.5-4 seconds, preferably for 1-3 seconds (i.e. exposure time), which are considered to be mild heating conditions.

The higher the selected temperature of the drying step is, the shorter the exposure time needs to be in order to prevent or at least mitigate the above disclosed over-drying of unprinted parts of the print substrate and hence prevent or at least mitigate deformation of the printed matter.

In an embodiment, the fixation step is performed at a temperature of above the MFFT of the polymer dispersion (latex) used in the ink.

In an embodiment, the fixation step is performed at a temperature of between 60° C. and 140° C., preferably between 65° C. and 120° C., more preferably between 70° C. and 100° C. for 0.5-4 seconds, preferably for 1-3 seconds, which are considered 'high heat' conditions.

BRIEF DESCRIPTION OF THE DRAWINGS

For a more complete understanding of the invention and the advantages thereof, exemplary embodiments of the invention are explained in more detail in the following description with reference to the accompanying drawing figures, in which like reference characters designate like parts and in which.

DETAILED DESCRIPTION

Figure 1:
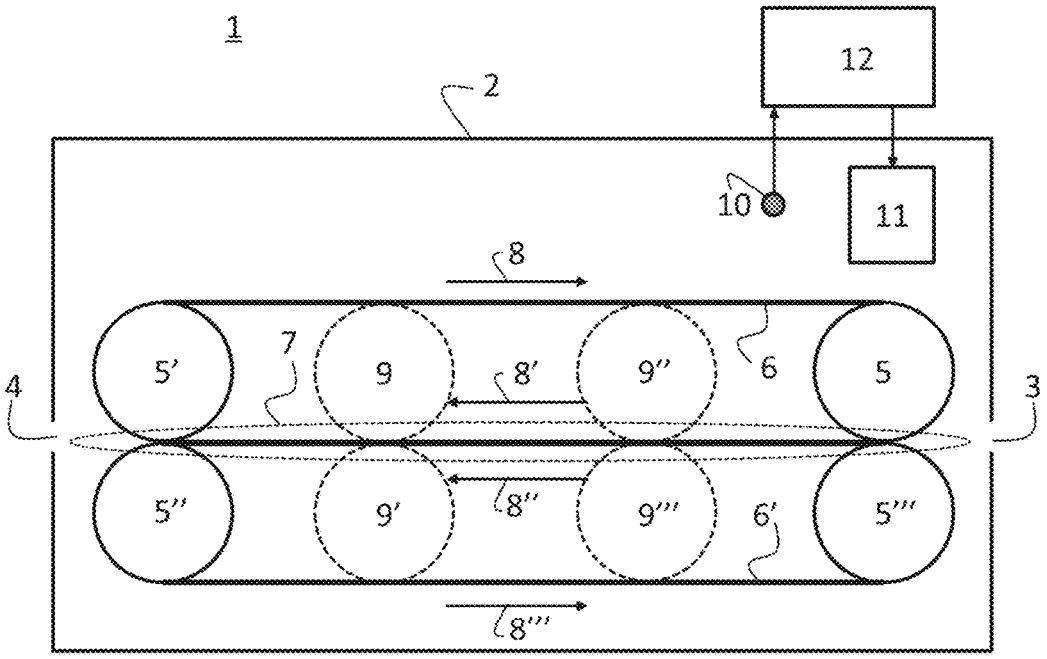
FIG. 1 Shows a schematic representation of the fixation unit according to the present invention.

FIG. 1 shows a schematic representation of a fixation unit 1 according to the present invention. The fixation unit comprises a substantial closed box 2 with an entrance slit 3 and an exit slit 4 for accommodating transport of a print substrate (not shown) through the fixation unit 1. The fixation unit further comprises rollers 5, 5', 5" and 5''' for engaging two belts 6 and 6". The belts are in contact with one another as to form a closed nip, which is encircled and indicated with 7 and in which the print substrate is fully enclosed during heating in the fixation unit. The belts 6 and 6" run concurrently and with (substantially) the same speed in the directions indicated by the arrows 8, 8', 8" and 8'''. The belts are made of an impermeable material with good release properties, (i.e. having low surface energy) and good heat resistance. Examples of suitable belt materials are (but not limited to) silicone rubber and Teflon™ (polytetrafluoroethylene rubber). Suitable belt materials may also be composite materials with a top layer (which in operation comes into contact with printed print substrates) of an impermeable material with good release properties, (i.e. having low surface energy) and good heat resistance, such as a silicone rubber or Teflon™. The top layer may be laminated onto or coated on a base material. In the context of the present invention, the belt material is not limited as long as an airtight belt nip can be formed. Optionally the belt nip is equipped with one or more additional pairs of rollers, e.g. pair 9 and 9' and pair 9" and 9'''. These optional additional pairs of rollers are arranged to provide additional pressure to the nip 7 to ensure that the entire nip is closed. Alternatively, the nip may run along a plate or between two plates (not shown).

The fixation unit further comprises a temperature sensor 10 and a heater 11 which are both connected to a controller 12. The controller 12 is arranged to control the temperature in the interior of the substantially closed box 2 of the fixation unit 1, based on the temperature sensed by the temperature sensor 10 and by providing heat with heater 11 accordingly to achieve a set point temperature inside the interior of the substantial closed box. Additionally, the temperature control may be assisted by the use of heated rollers (not shown, one or more of the rollers 5, 5', 5", 5''', 9, 9', 9" and 9''' may be heated rollers, the arranged heaters are then connected to controller 12. Alternatively, the temperature may be assisted by the above disclosed plates by implementing them as heated plates).

Figure 2:
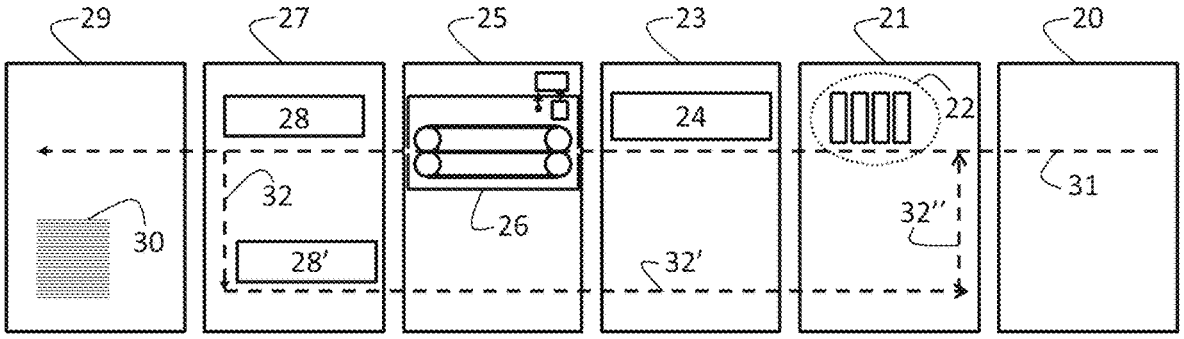
FIG. 2 Shows a schematic representation of a printing system in accordance with an embodiment of the present invention and comprising an image forming unit, a drying unit and a (post) fixation unit.

FIG. 2 shows a schematic representation of a printing system according to an embodiment the present invention. The printing system comprises a print substrate delivering module 20 arranged for delivering the print substrate to a printing module 21. The printing module comprises an image forming unit, comprising one or more imaging devices 22, e.g. ink jet print heads and an ink handling system (not shown) are provided. Downstream of the printing module 21, a drying (and pre-fixation) module 23 is arranged. The drying module comprises a drying device 24, which may be any drying device known in the art, for example one or more (hot) air impingement device(s). Downstream of the drying module 23, a fixation module 25 comprising a fixation unit 26 according to the present invention of which an embodiment is shown in FIG. 1 is arranged. Downstream of the fixation module 25 a cooling module 27 is arranged, comprising one or more coolers 28 and 28'. Finally, downstream of the coolers a stacking module 29 is arranged for stacking printed substrates 30.

All modules are equipped with transport devices (not shown) and couplings of the transport devices between the units (not shown) for enabling transport of a print substrate through the printing system as indicated with arrow 31. In case of cut sheet printing duplex printing is enabled by a return path indicated with arrows 32, 32' and 32". For duplex printing also a reverse loop is arranged in the transport path (not shown).

The embodiment shown in FIG. 2 is a duplex enabled cut sheet printing system. The present invention, which relates to two stage drying and fixation using a closed heater comprising a closed belt nip can also be applied to continuous feed printing. In that case, duplex printing is enabled by a second printing module. The duplex images is then dried by a second drying module and fixated by a second fixation module.

Figure 3:
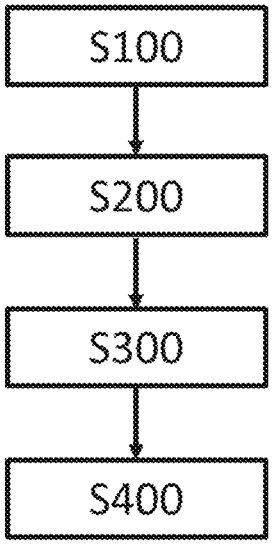
FIG. 3 Shows a schematic representation of a printing method in accordance with an embodiment of the present invention.

FIG. 3 shows a block diagram of a printing process according to the present invention. In a first step (S100) a print substrate and an ink set are provided. Applied to the printing system shown in FIG. 2, the print substrate may be provided from the print substrate delivering module 20 and the inks are delivered from the ink handling system (not shown) to the imaging devices 22. In a next step (S200) an image is printed onto a side of the print substrate in the printing module 21. In a next step (S300) the printed image is dried (and pre-fixated) such that it becomes robust enough for further handling in the printing system. The drying is performed in the drying module 23, for example by hot air impingement. The drying is performed at mild conditions, e.g. at a temperature of between 40° C. and 70° C. for 0.5-4 seconds. In a next step S400, the image is fixated by transporting the print substrate through a fixation unit 26 shown in FIG. 1, such that the print substrate is fully enclosed in an air-tight manner and exposed to high heat, for example a temperature of between 60° C. and 140° C. for 0.5-4 seconds.

After step S400, the prints are robust and not over-dried, because evaporation of water during fixation is prevented or at least mitigated and absorption of co-solvents into the print substrate is enhanced. Optionally, the prints are cooled and returned to the printing module 21 for duplex printing and/or added to the stack of prints in the stacking module (not shown in FIG. 3).

The invention claimed is:

1. A printing system comprising:

a printing module;

a substrate transport device arranged for transporting a print substrate through the printing system;

a drying module; and a fixation module arranged downstream of the printing module, the drying module being arranged downstream of the printing module and upstream of the fixation module, the fixation module comprising a fixation unit, the fixation unit comprising:

a substantially closed box for enclosing a heated space, the substantially closed box comprising an entry opening and an exit opening for enabling transport of the print substrate through the substantially closed box;

a heating element arranged for heating the heated space enclosed by the substantially closed box; and a transport mechanism for engaging a sheet of the print substrate from the entry opening to the exit opening of the substantially closed box, wherein the transport mechanism comprises a nip of two belts that are pressed together and run concurrently at substantially the same speed and in the same direction, the belts being impermeable to any ink component.

2. The printing system according to claim 1, wherein at least a surface of the belts that in operation comes in direct contact with printed matter comprises a material having a low surface energy for good release properties of the printed matter from the surfaces of the belts.

3. A printing method of using the printing system of claim 2, comprising the steps of:

providing a print substrate and an ink set, the ink set comprising at least one ink comprising a dispersion of polymer particles having a minimum film formation temperature (MFFT);

printing an image with the ink set onto the print substrate by transporting the print substrate through the printing module;

drying the printed substrate by transporting the print substrate through the drying module by exposing the print to mild heating conditions until the printed substrate is robust enough to be handled in further printing steps; and fixating the printed substrate by transporting the printed substrate through the fixation unit, and exposing the printed substrate to high heat.

4. A printing method of using the printing system of claim 1, comprising the steps of:

providing a print substrate and an ink set, the ink set comprising at least one ink comprising a dispersion of polymer particles having a minimum film formation temperature (MFFT);

printing an image with the ink set onto the print substrate by transporting the print substrate through the printing module;

drying the printed substrate by transporting the print substrate through the drying module by exposing the print to mild heating conditions until the printed substrate is robust enough to be handled in further printing steps; and fixating the printed substrate by transporting the printed substrate through the fixation unit and exposing the printed substrate to high heat.

5. The printing method according to claim 4, wherein the drying step is performed at a drying temperature of between 40° C. and 70° C., for 0.5-4 seconds.

6. The printing method according to claim 5, wherein, the fixation step is performed at a temperature of above the MFFT of the polymer dispersion (latex) used in the ink.

7. The printing method according to claim 5, wherein the fixation step is performed at a temperature of between 60° C. and 140° C. for 0.5-4 seconds.

8. The printing method according to claim 4, wherein, the fixation step is performed at a temperature of above the MFFT of the polymer dispersion (latex) used in the ink.

9. The printing method according to claim 8, wherein the fixation step is performed at a temperature of between 60° C. and 140° C. for 0.5-4 seconds.

10. The printing method according to claim 4, wherein the fixation step is performed at a temperature of between 60° C. and 140° C. for 0.5-4 seconds.

11. The printing method according to claim 1, wherein the drying module includes a hot air impingement device configured to provide a drying temperature of between 40° C. and 70° C., for 0.5-4 seconds to the print substrate.

* * * * *